US011686458B2

(12) United States Patent
Liu et al.

(10) Patent No.: US 11,686,458 B2
(45) Date of Patent: Jun. 27, 2023

(54) FIXING MECHANISM AND LAMP

(71) Applicant: Radiant Opto-Electronics Corporation, Kaohsiung (TW)

(72) Inventors: Shang-Chia Liu, Kaohsiung (TW); Chih-Hung Ju, Kaohsiung (TW); Guo-Hao Huang, Kaohsiung (TW)

(73) Assignee: Radiant Opto-Electronics Corporation, Kaohsiung (TW)

( * ) Notice: Subject to any disclaimer, the term of this patent is extended or adjusted under 35 U.S.C. 154(b) by 0 days.

(21) Appl. No.: 17/880,295

(22) Filed: Aug. 3, 2022

(65) Prior Publication Data

US 2023/0085297 A1 Mar. 16, 2023

Related U.S. Application Data

(63) Continuation of application No. PCT/CN2021/118840, filed on Sep. 16, 2021.

(51) Int. Cl.
*F21V 21/104* (2006.01)
*F21V 23/00* (2015.01)
(Continued)

(52) U.S. Cl.
CPC ..... *F21V 21/104* (2013.01); *F21V 17/12* (2013.01); *F21V 17/162* (2013.01); *F21V 23/002* (2013.01)

(58) Field of Classification Search
CPC ..... F21V 21/104; F21V 17/12; F21V 17/162; F21V 23/002
See application file for complete search history.

(56) References Cited

U.S. PATENT DOCUMENTS 4,787,592 A 11/1988 Aoshika
5,020,296 A * 6/1991 Aoshika ..... F21V 21/14 362/147

FOREIGN PATENT DOCUMENTS

CN 201201721 Y 3/2009
CN 201989701 U 9/2011
(Continued)

OTHER PUBLICATIONS

Machine Translation of FR-2780126-A1 (Year: 1999).*

*Primary Examiner* — Leah Simone Macchiarolo

(57) ABSTRACT

A fixing mechanism comprises a casing, a plurality of clamping members, and a biasing member respectively configured in the casing. The casing includes an inner surface and surrounds an accommodating space, and the accommodating space has a large-diameter end and a small-diameter end. The plurality of clamping members are configured in the accommodating space, and each clamping member has an outer surface facing the inner surface. A cross section of the outer surface along the axial direction is arc-shaped and the outer surface of the clamping member contacts with the inner surface of the casing partially. The clamping members can be pushed toward the large-diameter end of the accommodating space to separate the clamping members from each other, so that the wire can move between the clamping members. The biasing member is disposed in the accommodating space and located on one side of the large-diameter end. The biasing member can push the clamping members toward the small-diameter end of the accommodating space to make the clamping members close to each other to clamp the wire. Therefore, the contact area and friction force between the clamping members and the inner surface of the casing can be reduced, and the convenience of the operation can be improved. The invention also provides a lamp using the fixing mechanism.

14 Claims, 10 Drawing Sheets

(51) Int. Cl.
*F21V 17/16* (2006.01)
*F21V 17/12* (2006.01)

(56) References Cited

FOREIGN PATENT DOCUMENTS

| | | | | | |
|---|---|---|---|---|---|
| CN | 103185318 | A | | 7/2013 | |
| CN | 105371164 | A | | 3/2016 | |
| CN | 209245872 | U | | 8/2019 | |
| CN | 110701520 | A | | 1/2020 | |
| CN | 112204304 | A | | 1/2021 | |
| FR | 2780126 | A1 | * | 12/1999 | ..... E04C 5/122 |
| TW | 201239246 | A1 | | 10/2012 | |
| WO | WO-2004085876 | A1 | * | 10/2004 | ..... F16G 11/04 |

* cited by examiner

FIXING MECHANISM AND LAMP

RELATED APPLICATIONS

This application is a continuation application of International Application No. PCT/CN2021/118840, filed on, Sep. 16, 2021. The entire disclosures of all the above applications are hereby incorporated by reference.

FIELD OF THE INVENTION

The present invention relates to a fixing mechanism, especially to a fixing mechanism which is not easy to damage the inner wire and easy to adjust, and a lamp using the fixing mechanism.

BACKGROUND OF THE INVENTION

Lighting devices are indispensable products for modern life. Generally speaking, they can be divided into fixed lighting devices that are fixed to the ceiling, or suspended lighting devices that are suspended from the ceiling.

The suspended lighting device uses a plurality of suspended wires to connect to a power source from the ceiling and a light-emitting element (such as a light bulb), and the power source uses these suspended wires to transmit power to the light-emitting element. The suspended wire is usually provided with a clamping mechanism to adjust the distance between the suspended lighting device and the ceiling.

However, the conventional clamping mechanism uses steel balls to clamp the suspension wire inwards. The heavier the load is, the tighter the steel balls are clamped inwards. If the suspension wire is an electric wire, the insulating layer of the electric wire will be pinched and damaged to cause electric leakage. In addition, the suspension wire and the clamping mechanism are usually fixed, therefore, after the height of the conventional suspension lighting device is determined, it cannot be adjusted again according to the needs of the user.

SUMMARY OF THE INVENTION

One object of the present invention is to provide a fixing mechanism that is not easy to damage the suspension wire and is easy to adjust.

The fixing mechanism is used for a wire to pass through and be clamped and fixed. The fixing mechanism comprises a casing, a plurality of clamping members disposed in the casing, and a biasing member. The casing has an inner surface which surrounds an accommodating space that communicates with the outside and extends along the axial direction of the casing. The accommodating space has a large-diameter end and a small-diameter end. The clamping members are arranged in the accommodating space of the casing. Each of the clamping members has an outer surface facing the inner surface of the casing, and a cross section of the outer surface along the axial direction is arc-shaped and the outer surface of the clamping member contacts with the inner surface partially. The clamping members can be pushed toward the large-diameter end of the accommodating space to separate the clamping members from each other, so that the wire can move between the clamping members. The biasing member is disposed in the accommodating space and located on the side of the clamping members facing the large-diameter end. The biasing member can push the clamping members toward the small-diameter end of the accommodating space to make the clamping members close to each other to clamp the wire.

In a preferable embodiment, there are gaps revealed above and below the contact position between the outer surface of the clamping members and the casing along the axial direction of the casing.

In a preferable embodiment, the inner surface has an inclined section, one end of the inclined section forms the large-diameter end, and the other end of the inclined section forms the small-diameter end. The diameter of the inclined section is tapered from the large-diameter end toward the small-diameter end. In a preferable embodiment, the inclined section of the inner surface of the casing has a fixed slope, and the outer surfaces of the clamping members are tangent to the inclined section of the inner surface of the casing with their arc-shaped surface.

In a preferable embodiment, the inner surface has an inclined section and an extended section connected below the inclined section, one end of the inclined section forms the large-diameter end, and one end of the extended section forms the small-diameter end.

In a preferable embodiment, each of the clamping members further has a clamping groove facing the other clamping members, and the clamping groove extending along the axial direction of the casing.

In a preferable embodiment, the clamping groove of each of the clamping members is formed with a rough surface or an internal thread.

In a preferable embodiment, the fixing mechanism further includes an upper cover disposed on the top of the casing, and the biasing member is pressed between the upper cover and the clamping members.

In a preferable embodiment, the fixing mechanism further includes a releasing member, which is arranged in the accommodating space and is located on the side of the clamping member facing the small-diameter end. The bottom of the casing has a through hole, and the releasing member is hollow and has a push rod extending through the through hole and a protruding wall extending radially outward from the top end of the push rod. The diameter of the protruding wall is larger than the diameter of the through hole, and a part of the push rod protrudes from the through hole.

In a preferable embodiment, the fixing mechanism further includes a screwing member combined with the push rod of the releasing member. The outer surface of the push rod is formed with an external thread for the screwing member to be screwed together.

In a preferable embodiment, the outer surface of the push rod has at least one anti-rotation plane extending along its axial direction, and the shape of the through hole of the casing is matched with the at least one anti-rotation plane.

Another object of the present invention is to provide a lamp which comprises at least one fixing mechanism as described above, a wire passing through the fixing mechanism, and a light source connecting the wire.

Another object of the present invention is to provide a lamp which comprises at least one fixing mechanism as described above, a wire passing through the fixing mechanism, and a light source connecting the wire. The push rod of the releasing member of the fixing mechanism and the screwing member are fixed to an external environment, so that the wire can be fixed or moved relative to the external environment.

The characteristic of the present invention is that the outer surface of each of the clamping members is arc-shaped, so the contact area with the inner surface of the casing can be reduced, thereby reducing the frictional force between the casing and the clamping members. Therefore, it is easier for a releasing member to push the clamping members and improves the convenience of operation.

DETAILED DESCRIPTION OF THE INVENTION

The detailed description and preferred embodiments of the invention will be set forth in the following content and provided for people skilled in the art to understand the characteristics of the invention.

Figure 1:
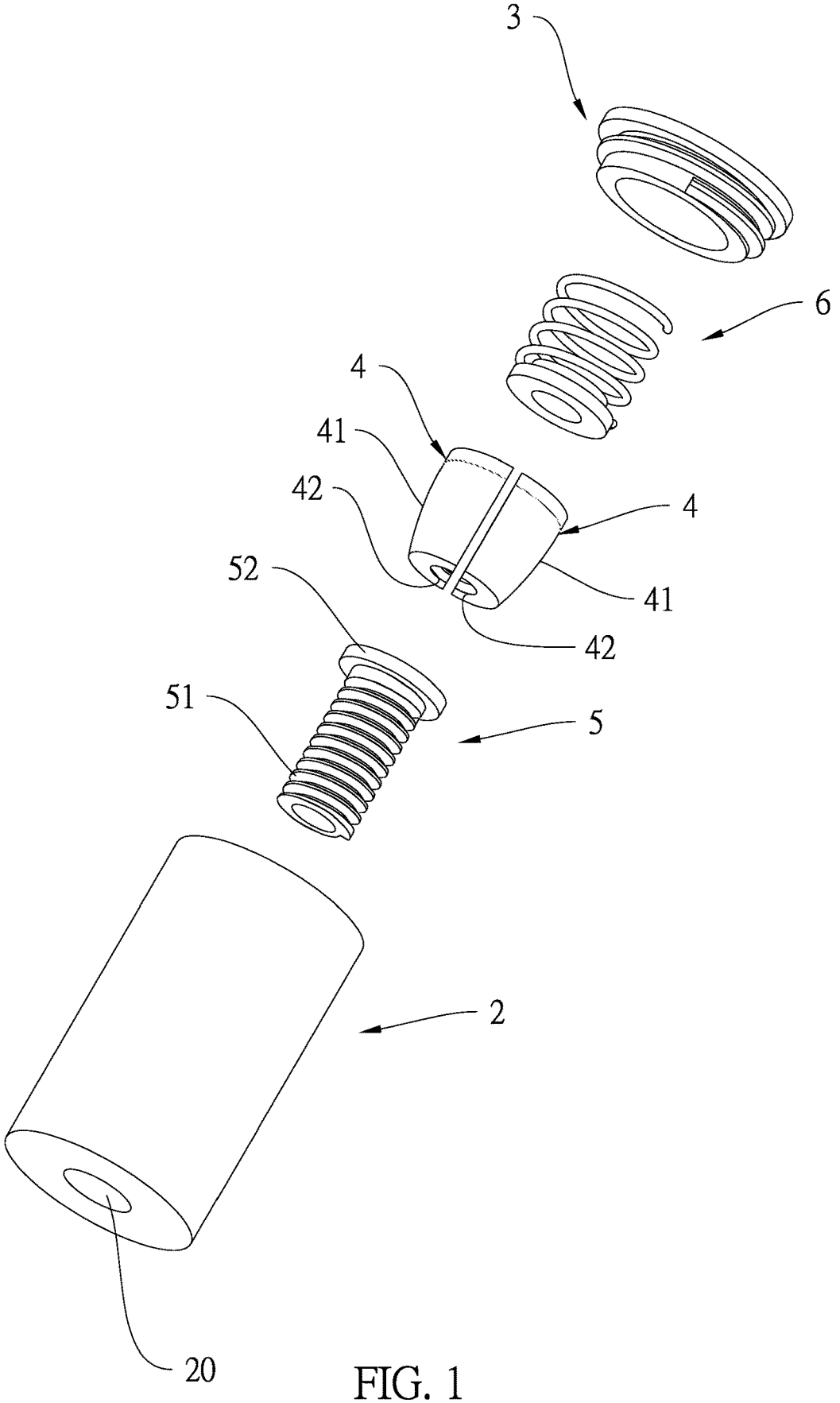
FIG. 1 is an exploded diagram of a fixing mechanism according to a first embodiment of this invention.
Figure 2:
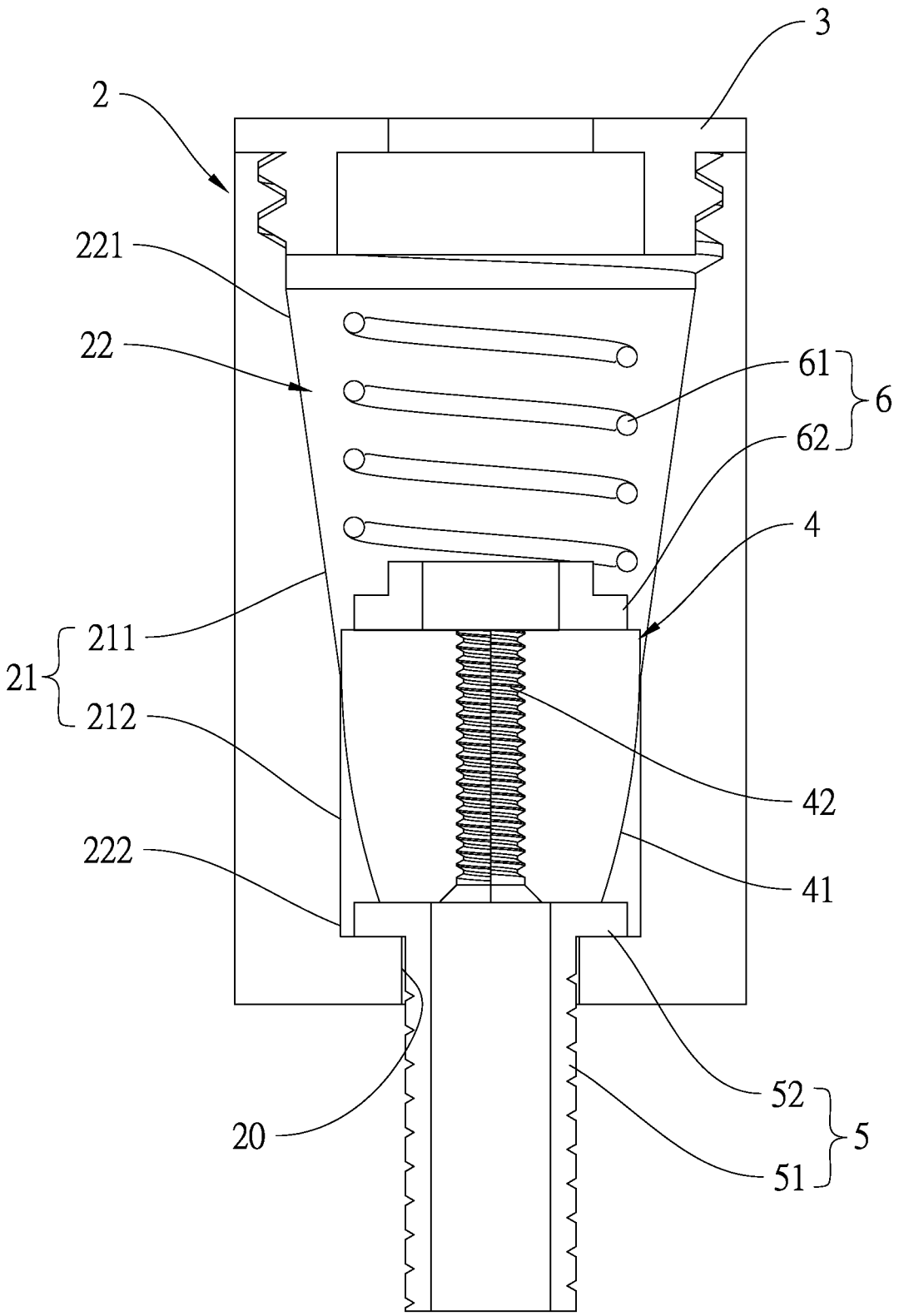
FIG. 2 is a cross-sectional diagram illustrating the assembled structure of FIG. 1.

Referring to FIG. 1 and FIG. 2, it is a first preferred embodiment of the fixing mechanism of the present invention. The fixing mechanism comprises a casing 2, an upper cover 3 disposed on the top of the casing 2, a plurality of clamping members 4, a releasing member 5, and a biasing member 6, wherein the clamping members 4, the releasing member 5, and the biasing member 6 are arranged in the casing 2 respectively. The clamping members 4 are located between the releasing member 5 and the biasing member 6. One end of the biasing member 6 abuts against the upper cover 3, and the other end of the biasing member 6 abuts one end of the clamping members 4.

As shown in FIG. 2, the casing 2 has an inner surface 21 which surrounds an accommodating space 22 which communicates with the outside and extends along the axial direction of the casing 2. The accommodating space 22 has a large-diameter end 221 and a small-diameter end 222. It should be noted that, in this embodiment, the inner wall surface 21 has an inclined section 211 and an extended section 212 connected below the inclined section 211. One end of the inclined section 211 forms the large-diameter end 221, and one end of the extending section 212 forms the small-diameter end 222. The diameter of the inclined section 211 is tapered off along the direction to the extended section 212. The diameter of the extended section 212 is uniform and is the same as the minimum diameter of the inclined section 211. In some embodiments, the inner surface 21 may also have only the inclined section 211, one end of the inclined section 211 forms the large-diameter end 221, and the other end of the inclined section 211 forms the small-diameter end 222. The diameter of the inclined section 211 is tapered off from the large-diameter end 221 toward the small-diameter end 22.

The clamping members 4 are disposed in the inclined section 211 of the accommodating space 22. Each of the clamping members 4 has an outer surface 41 facing the inner surface 21 of the casing 2, and a clamping groove 42 facing the other clamping member 4. The clamping groove 42 extends along the axial direction of the casing 2, and a channel 40 is surrounded by the clamping members 4. A cross section of the outer surface 41 of each clamping members 4 along the axial direction is arc-shaped and the outer surface 41 of the clamping members 4 contacts with the inner surface 21 partially.

The releasing member 5 is hollow, arranged in the accommodating space 22 and located on the side of the clamping members 4 toward the small-diameter end 222. Part of the releasing member 5 protrudes out of the casing 2. In this embodiment, the releasing member 5 is disposed in the extended section 212. The bottom of the casing 2 has a through hole 20, the releasing member 5 has a push rod 51 extending through the through hole 20, and a protruding wall 52 extending radially outward from the top end of the push rod 51. The diameter of the protruding wall 52 is larger than the diameter of the through hole 20, and a part of the push rod 51 protrudes from the through hole 20.

The biasing member 6 is disposed in the accommodating space 22 and between the clamping members 4 and the upper cover 3. In this embodiment, the biasing member 6 has a spring 61 and a ring-shaped washer 62 disposed at the bottom of the spring 61. The arrangement of the ring-shaped washer 62 can increase the contact area with the clamping members 4 and can also make the pushing force of the spring 61 to the clamping member 4 more evenly. In some embodiments, the biasing member 6 may also be a single spring 61, which is not limited to what is disclosed in this embodiment.

Figure 3:
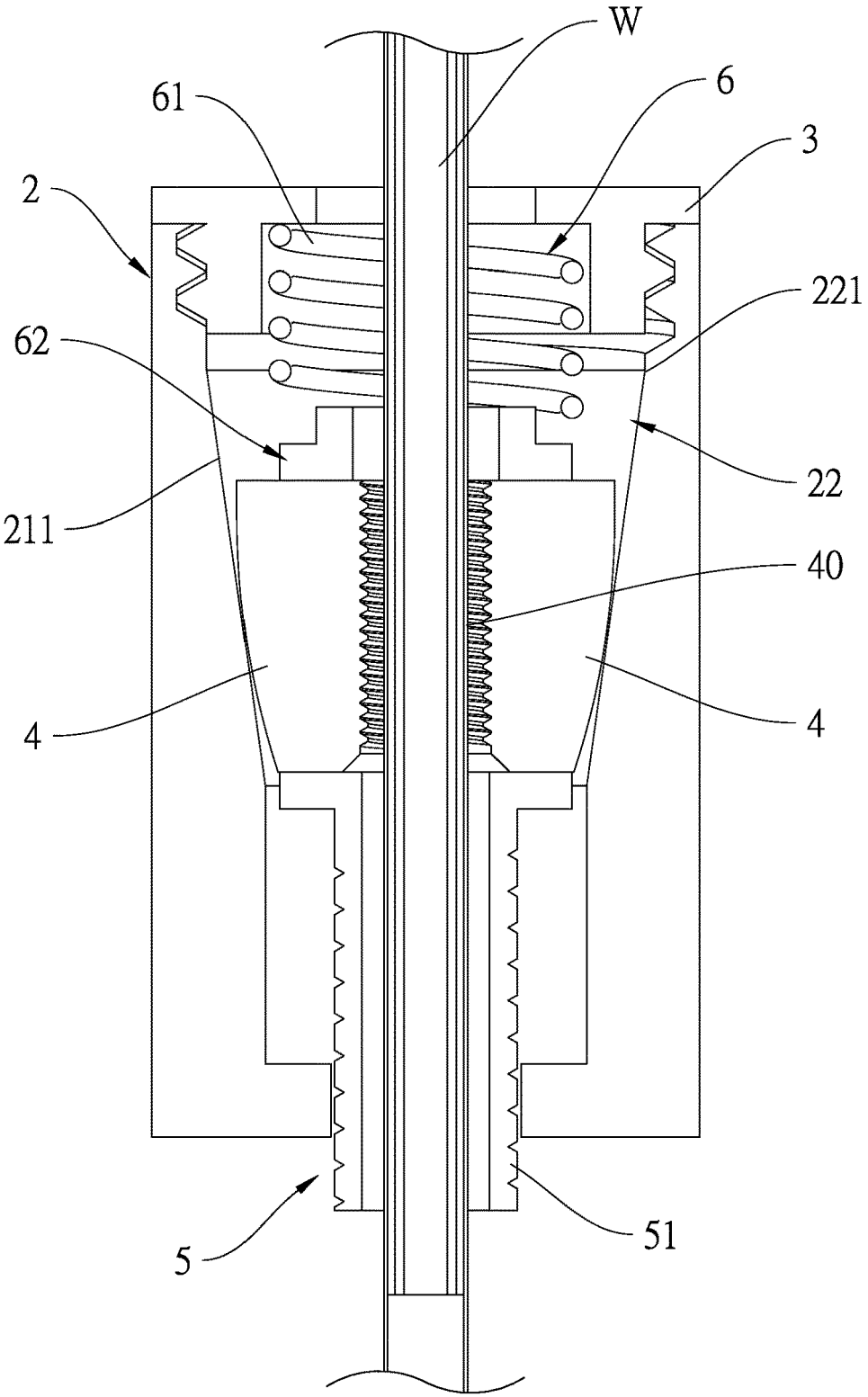
FIG. 3 is a cross-sectional diagram illustrating a releasing member pushing against a plurality of clamping members.

Referring to FIG. 3, when threading a cable in the fixing mechanism of the present invention, the push rod 51 of the releasing member 5 is be pushed toward the direction of the casing 2 first. The protruding wall 52 of the releasing member 5 is brought close to the clamping members 4 and pushes the clamping members 4 to move towards the direction of the large-diameter end 221 in the accommodating space 22. At this time, the clamping members 4 will press against the spring 61 of the biasing member 6 to exert an elastic restoring force. Since the diameter of the inclined section 211 is gradually increasing toward the large-diameter end 221, the channel 40 surrounded by the clamping members 4 will become broader when the clamping members 4 move toward the large-diameter end 221. At this time, a wire W can be passed through the releasing member 5, the channel 40, the biasing member 6, and the upper cover 3 in sequence. The wire W can be a suspension wire or an electric wire. The width of the channel 40 is larger than the diameter of the wire W, so that the wire W can penetrate it smoothly.

Figure 4:
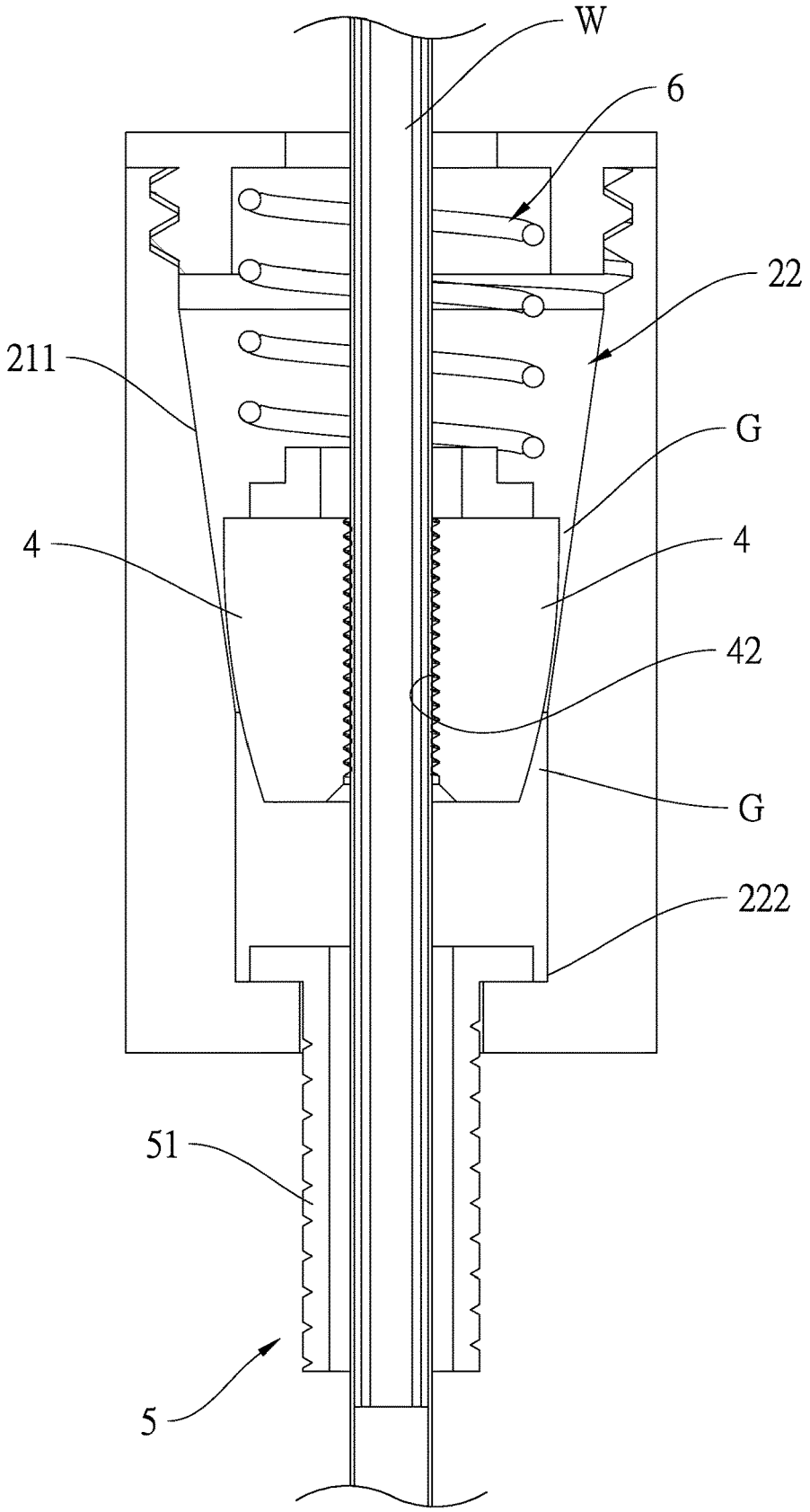
FIG. 4 is a cross-sectional diagram illustrating the combination of the fixing mechanism of the first preferred embodiment with a wire.

After the wire W has passed through the channel 40 until the fixed position of the wire W between the clamping members 4 is determined, the releasing member 5 can no longer be applied with force. At this time, the elastic restoring force accumulated by the biasing member 6 will push the clamping members 4 toward the small-diameter end 222 of the accommodating space 22, and the clamping members 4 are moved along the inner surface 21 of the casing 2 toward the small-diameter end 222. The clamping members 4 gradually approach to each other to reduce the diameter of the channel 40, until the clamping members 4 fit and position the wire W, as shown in FIG. 4. Each of the clamping members 4 has the clamping groove 42. Compare to the wire W squeezed by steel balls directly in the prior art, the contact area between the clamping groove 42 and the wire W is bigger than the prior art, so the fixing mechanism of the present invention can not only achieve the position purpose, but also avoid damaging the wire W and prolong the use period of the wire W. Moreover, each of the clamping groove 42 is formed with a rough surface or an internal thread to increase friction to improve the position effect between the wire W and the clamping members 4. It should be noted that the inclined section 211 has a fixed slope, and the outer surface 41 of the clamping members 4 partially contacts with the inclined section 211 through its arc-shaped surface in a tangent manner. Therefore, there are gaps G revealed above and below the contact position between the outer surface 41 of each of the clamping members 4 and the casing 2 along the axial direction of the casing 2. Since there is only partial contact between the clamping members 4 and the casing 2, the frictional force is also smaller due to the small contact area. It makes it easier for the releasing member 5 to push the clamping members 4 and improves the convenience of operation.

Figure 5:
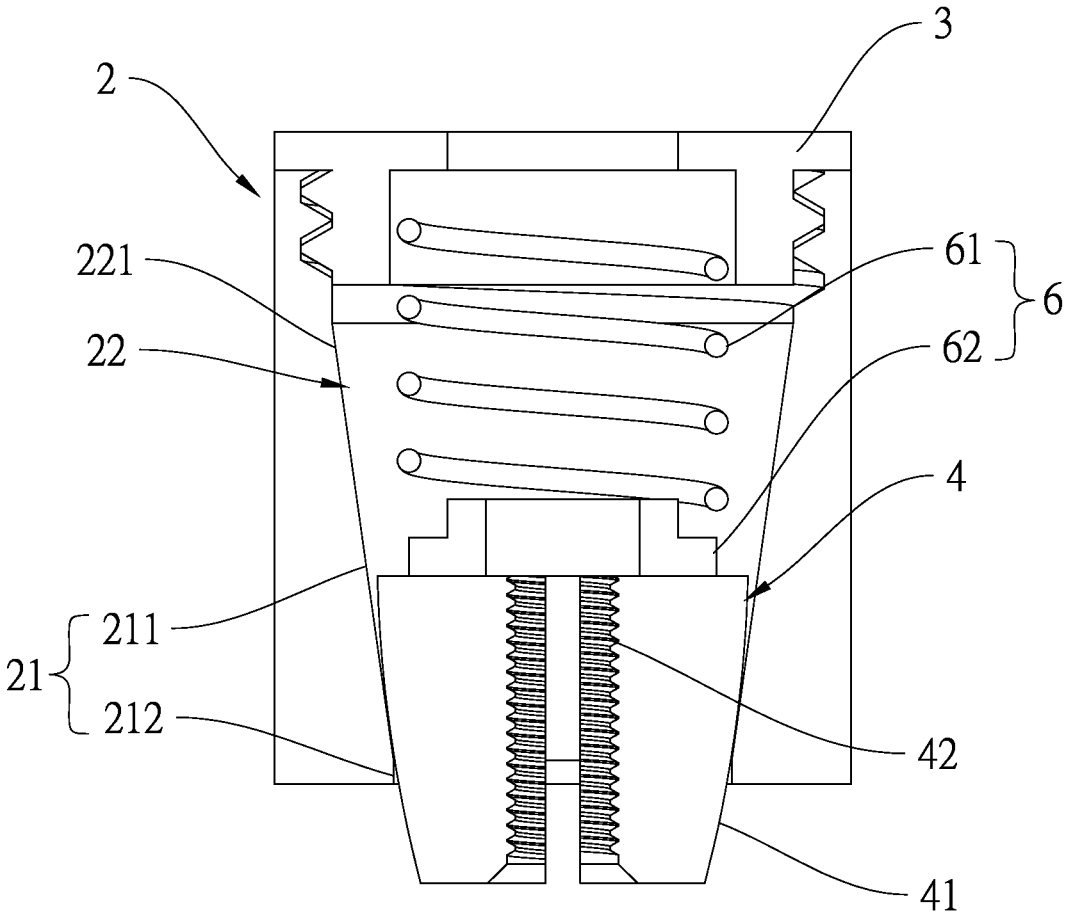
FIG. 5 is a cross-sectional diagram illustrating another type of the first preferred embodiment.

Referring to FIG. 5, in another preferred embodiment of the fixing mechanism of the present invention, the releasing member 5 can be omitted. Another preferred embodiment of the fixing mechanism of the present invention includes a casing 2, an upper cover 3 disposed on a top of the casing 2, a plurality of clamping members 4 and a biasing member 6 disposed in the casing 2. One end of the biasing member 6 is pressed against the upper cover 3, the other end of the biasing member 6 is in contact with one end of the clamping members 4, and the other end of the clamping members 4 extend out of the casing 2. At the same time, the wire W is clamped by the clamping members 4 and cannot move relative to the clamping members 4. When a user wants to adjust the height of the lamp, the wire W can be released as long as the clamping members 4 are pushed up and moved toward the upper cover 3. After the height of the lamp is adjusted, the clamping members 4 are not being pushed, and the relative position of the wire W and the clamping members 4 can be determined by the elastic restoring force of the biasing member 6.

Therefore, the fixing mechanism of the present invention has the following characteristics:

1. Easy to operate: Since the outer surface 41 of each of the clamping members 4 is arc-shaped, it only forms a partial contact between the outer surface 41 of the clamping members 4 and the inner surface 21, and there are gaps G revealed above and below the contact position along the axial direction of the casing 2. In this way, the frictional force between the clamping members 4 and the casing 2 is reduced, so that the releasing member 5 is easier to push the clamping members 4, and the convenience of the operation is improved.
2. Avoid damaging to the wire W: Compare to the wire W directly squeezed by steel balls in the prior art, the contact area between the clamping groove 42 and the wire W is bigger than the prior art, so the fixing mechanism of the present invention can not only achieve the position purpose, but also avoid damaging to the wire W and prolong the use period of the wire W. Moreover, each of the clamping groove 42 is formed with a rough surface or an internal thread to increase friction to improve the position effect between the wire W and the clamping members 4.

Figure 6:
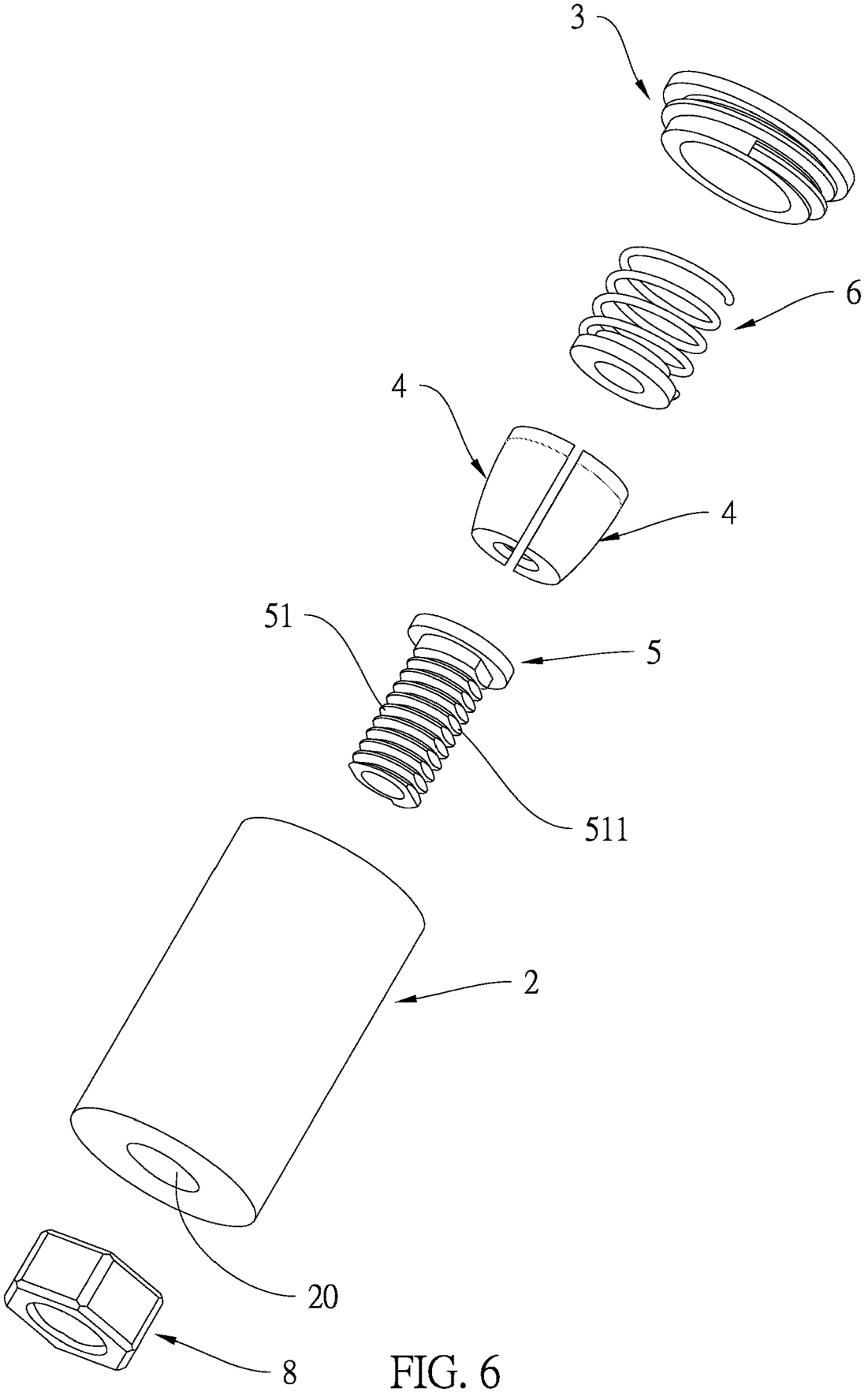
FIG. 6 is an exploded diagram illustrating a fixing mechanism according to a second embodiment of this invention.
Figure 7:
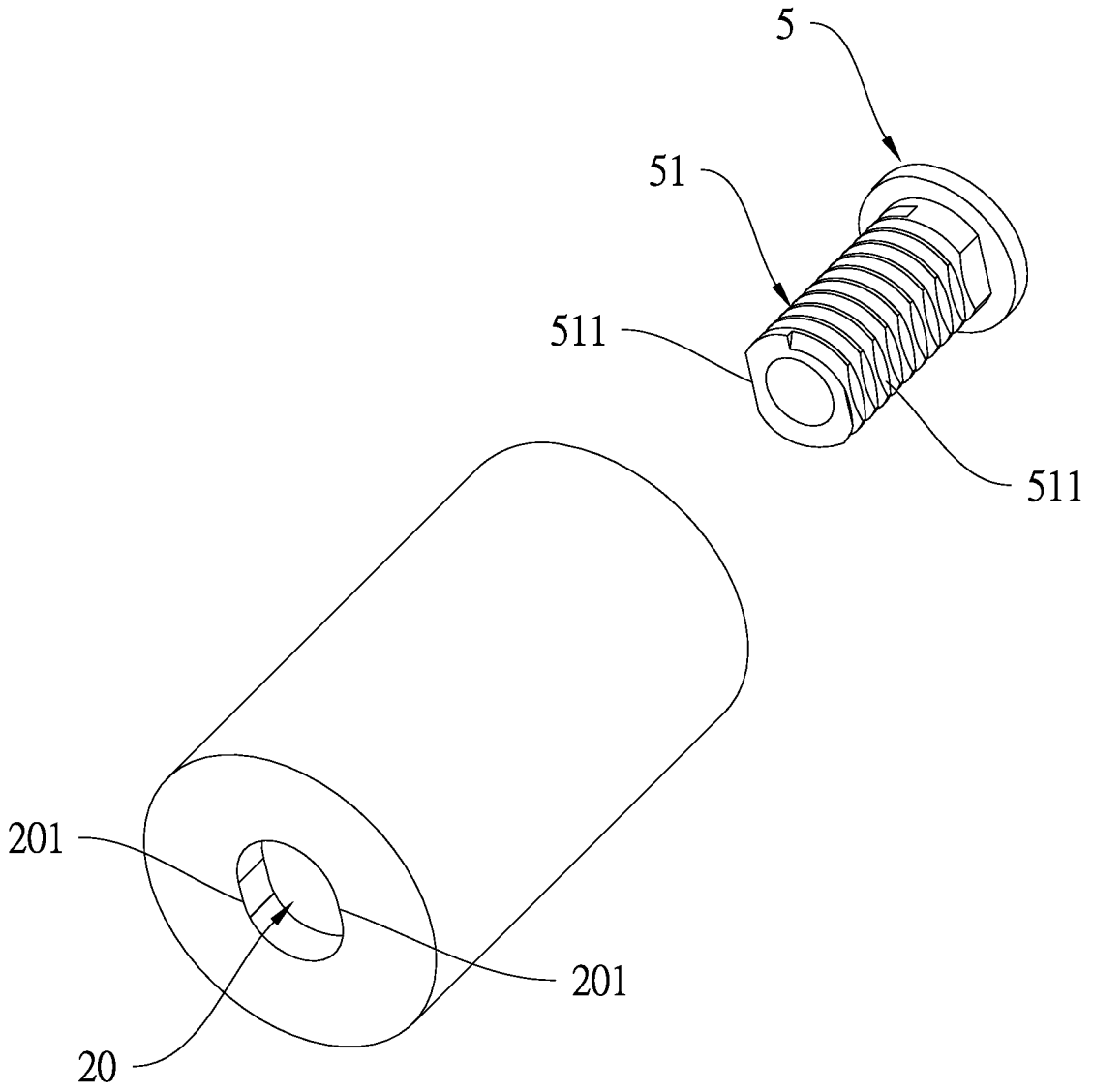
FIG. 7 is a partial enlarged diagram illustrating the shape of a through hole at the bottom of a casing in FIG. 6.

Referring to FIG. 6, it is the second preferred embodiment of the fixing mechanism of the present invention. The fixing mechanism also includes a casing 2, an upper cover 3 disposed on the top of the casing 2, a plurality of clamping members 4, a releasing member 5, and a biasing member 6, wherein the clamping members 4, the releasing member 5, and the biasing member 6 are disposed in the casing 2 respectively. The difference is that the second preferred embodiment further includes a screwing member 8 combined with the releasing member 5. Referring to FIG. 7, it should be noted that, the outer annular surface of the push rod 51 has at least one anti-rotation plane 511 extending along its axial direction. The shape of the through hole 20 of the casing 2 is matched with the anti-rotation plane 511 in a cross section, such as the plane 201 of the through hole 20 shown in FIG. 7, which can limit the rotation of the releasing member 5.

Figure 8:
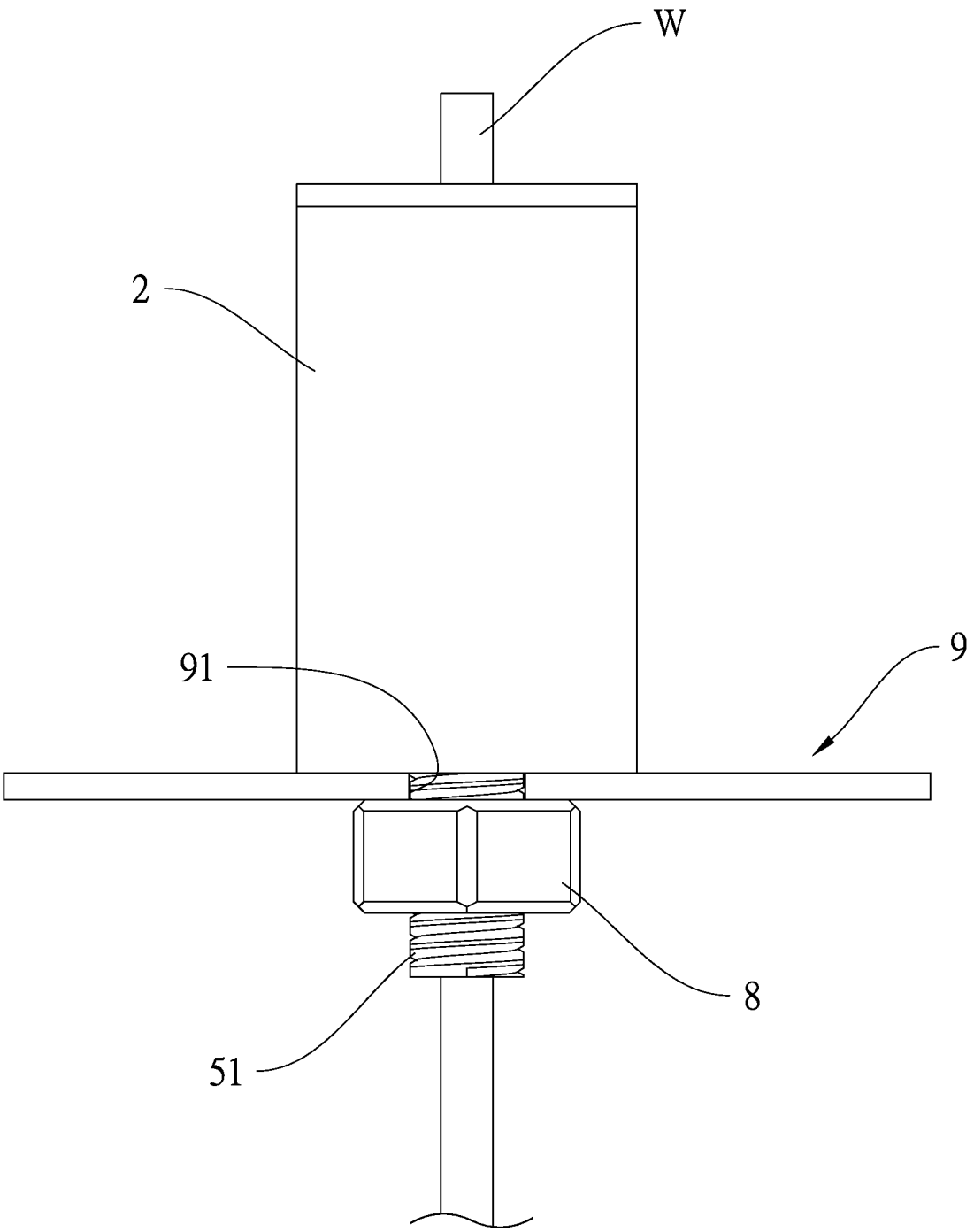
FIG. 8 is a cross-sectional diagram illustrating the fixing mechanism of the second preferred embodiment in combination with an external environment.

Referring to FIG. 8 and FIG. 7, the fixing mechanism of the present invention can be combined with an external environment 9. The external environment 9 has an installation hole 91, the push rod 51 of the releasing member 5 passes through the installation hole 91, and the screwing member 8 is screwed onto the push rod 51 from below. When the screwing member 8 performs the screwing action, the releasing member 5 will not rotate along with it because the anti-rotation planes 511 of the push rod 51 matched with the planes 201 of the through hole 20 of the casing 2. Therefore, the screwing operation can be performed smoothly.

Figure 9:
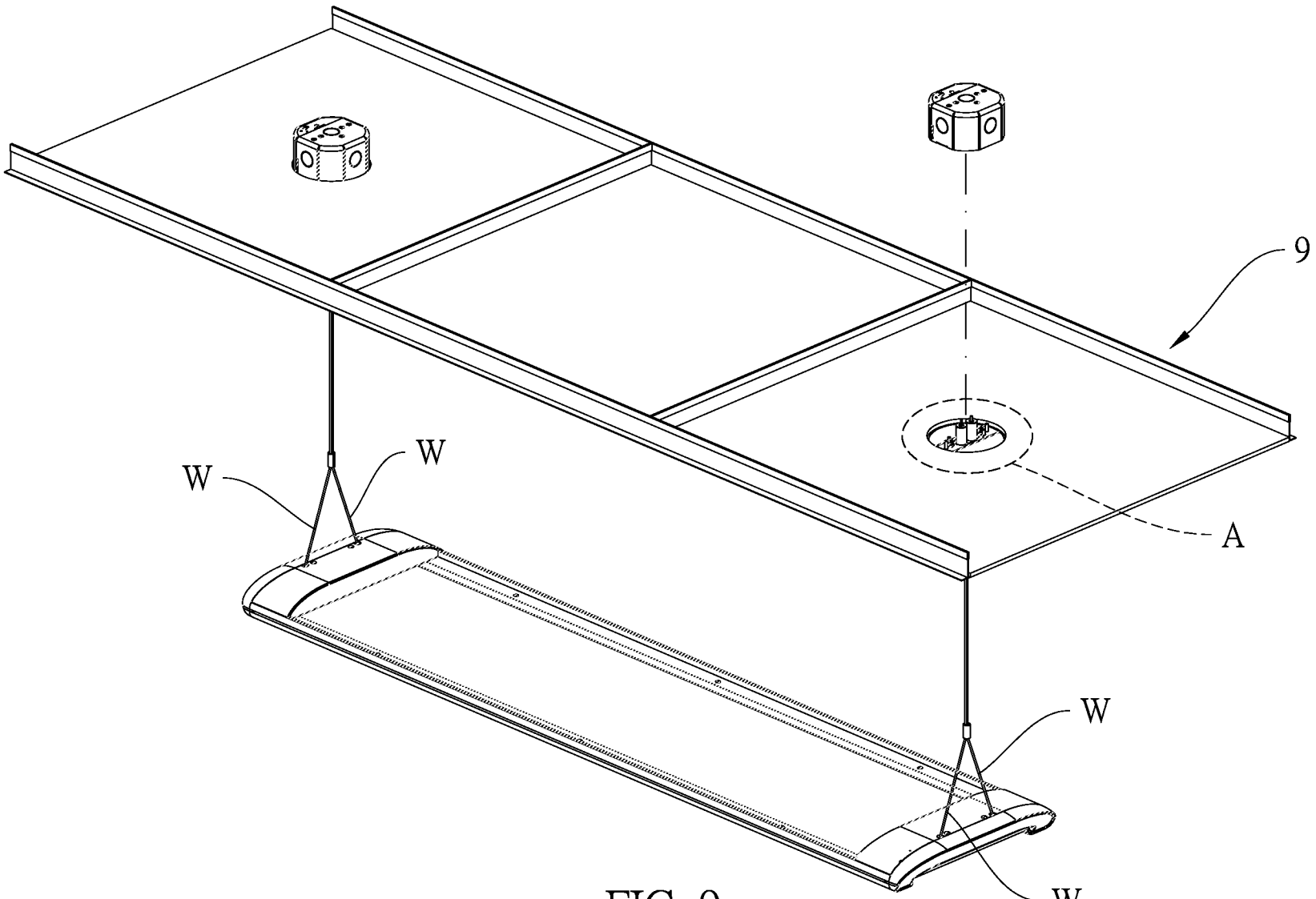
FIG. 9 is a perspective view of a preferred embodiment of the lamp of the present invention.
Figure 10:
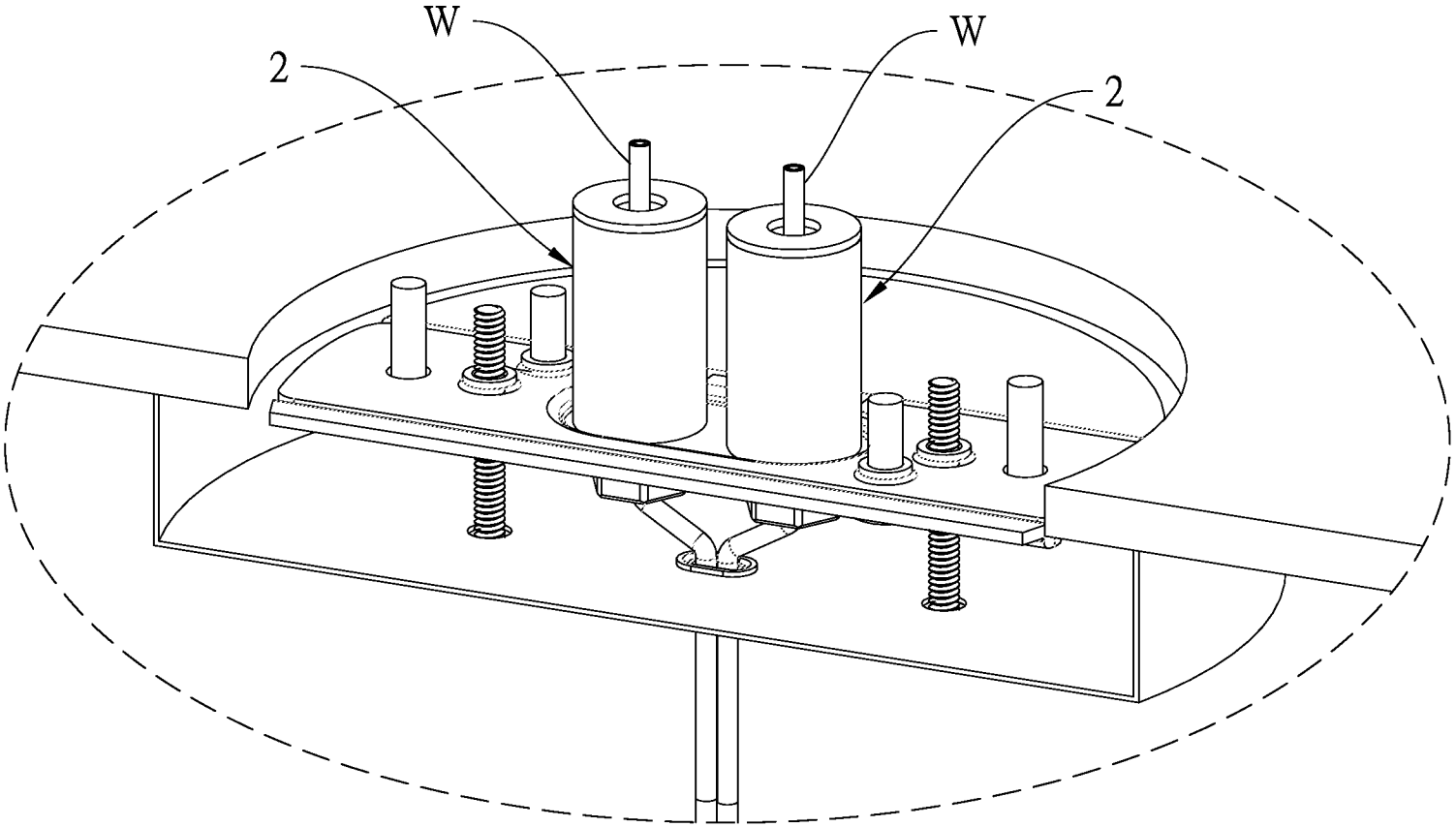
FIG. 10 is a perspective view, which is an enlarged view of part of FIG. 9.

In addition, when the fixing mechanism of the present invention is applied to a suspended lamp, the lamp includes four wires W, as shown in FIG. 9 and FIG. 10, wherein FIG. 10 is an enlarged view of the circle frame A in FIG. 9. One end of the wires W is fixed with the lamp, and the other end of the wires W is fixed to an external environment 9 (such as the ceiling) by using the push rod 51 and the screw 8 (see FIG. 8) of the fixing mechanism of the present invention. When the user wants to increase the suspension height of the lamp, the excess length of the wire W can be stored above the ceiling. The steps for adjusting the height of the lamp are simplified and convenient, and the overall appearance of the lamp is free from redundant wires, which is visually simple and beautiful. In another embodiment, the fixing mechanism of the present invention can also be arranged at one end of the wire W which is closer to the lamp. When the user wants to increase the suspension height of the lamp, the excess part of the wire W can be stored in the interior space of the lamp.

To sum up, since the surface of the outer surface 41 of the clamping members 4 is arc-shaped, the fixing mechanism and the lamp of the present invention can reduce the contact area and the frictional force between the clamping members 4 and the casing 2. It makes it easier for the releasing member 5 to push the clamping members 4 and improves the convenience of operation. At the same time, the design of the clamping groove 42 of the clamping member 4 can reduce the damage to the wire W and prolong the use period of the wire W.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A fixing mechanism is used for a wire to pass through and be clamped and fixed, and the fixing mechanism comprising:

a casing has an inner surface which surrounds an accommodating space that communicates with the outside and extends along the axial direction of the casing, wherein the accommodating space has a large-diameter end and a small-diameter end;

a plurality of clamping members are arranged in the accommodating space of the casing, wherein each of the clamping members has an outer surface facing the inner surface of the casing, and a cross section of the outer surface along the axial direction is arc-shaped and the outer surface of the clamping member contacts with the inner surface of the casing partially, wherein the clamping members can be pushed toward the large-diameter end of the accommodating space to separate the clamping members from each other, so that the wire can move between the clamping members; and a biasing member is disposed in the accommodating space and located on the side of the clamping members facing the large-diameter end, wherein the biasing member can push the clamping members toward the small-diameter end of the accommodating space to make the clamping members close to each other to clamp the wire.

2. The fixing mechanism as claimed in claim 1, wherein there are gaps revealed above and below the contact position between the outer surface of the clamping members and the casing along the axial direction of the casing.

3. The fixing mechanism as claimed in claim 1, wherein the inner surface has an inclined section, one end of the inclined section forms the large-diameter end, the other end of the inclined section forms the small-diameter end, and the diameter of the inclined section is tapered from the large-diameter end toward the small-diameter end.

4. The fixing mechanism as claimed in claim 3, wherein the inclined section of the inner surface of the casing has a fixed slope, and the outer surfaces of the clamping members are tangent to the inclined section of the inner surface of the casing with their arc-shaped surface.

5. The fixing mechanism as claimed in claim 1, wherein the inner surface has an inclined section and an extended section connected below the inclined section, one end of the inclined section forms the large-diameter end, and one end of the extended section forms the small-diameter end.

6. The fixing mechanism as claimed in claim 5, wherein the inclined section of the inner surface of the casing has a fixed slope, and the outer surfaces of the clamping members are tangent to the inclined section of the inner surface of the casing with their arc-shaped surfaces.

7. The fixing mechanism as claimed in claim 1, wherein each of the clamping members further has a clamping groove facing the other clamping members, and the clamping groove extending along the axial direction of the casing.

8. The fixing mechanism as claimed in claim 7, wherein the clamping groove of each of the clamping members is formed with a rough surface or an internal thread.

9. The fixing mechanism as claimed in claim 1, wherein the fixing mechanism further includes an upper cover disposed on the top of the casing, and the biasing member is pressed between the upper cover and the clamping members.

10. The fixing mechanism as claimed in claim 9, wherein the fixing mechanism further includes a releasing member, which is arranged in the accommodating space and is located on the side of the clamping member facing the small-diameter end, wherein the bottom of the casing has a through hole, the releasing member is hollow and has a push rod extending through the through hole and a protruding wall extending radially outward from the top end of the push rod, the diameter of the protruding wall is larger than the diameter of the through hole, and a part of the push rod protrudes from the through hole.

11. The fixing mechanism as claimed in claim 10, wherein the fixing mechanism further includes a screwing member combined with the push rod of the releasing member, wherein the outer surface of the push rod is formed with an external thread for the screwing member to be screwed together.

12. The fixing mechanism as claimed in claim 11, wherein the outer surface of the push rod has at least one anti-rotation plane extending along its axial direction, and the shape of the through hole of the casing is matched with the at least one anti-rotation plane.

13. A lamp, comprising at least one fixing mechanism as described in claim 11, a wire passing through the fixing mechanism, and a light source connecting the wire, wherein the push rod of the releasing member of the fixing mechanism and the screwing member are fixed to an external environment, so that the wire can be fixed or moved relative to the external environment.

14. A lamp, comprising at least one fixing mechanism as described in claim 1, a wire passing through the fixing mechanism, and a light source connecting the wire.

* * * * *